US005791778A

United States Patent [19]

Manninen et al.

[11] Patent Number: 5,791,778

[45] Date of Patent: Aug. 11, 1998

[54] METHOD AND APPARATUS FOR MIXING GASEOUS CHEMICAL TO FIBER SUSPENSION

[75] Inventors: Matti Manninen; Kari Peltonen; Reijo Vesala, all of Kotka, Finland

[73] Assignee: A. Ahlstrom Corporation, Noormarkku, Finland

[21] Appl. No.: 767,524

[22] Filed: Dec. 16, 1996

Related U.S. Application Data

[63] Continuation of Ser. No. 377,745, Jan. 25, 1995, abandoned.

[30] Foreign Application Priority Data

| | | | |
|---|---|---|---|
| Jan. 25, 1994 | [FI] | Finland | 940371 |
| Nov. 18, 1994 | [FI] | Finland | 945425 |

[51] Int. Cl.[6] ..... B01F 5/04

[52] U.S. Cl. ..... 366/171.1; 366/172.1; 366/304; 366/306; 366/307

[58] Field of Search ..... 366/168.1, 171.1, 366/172.2, 173.1, 174.1, 175.2, 181.4, 303, 306, 307, 304; 162/57, 243

[56] References Cited

U.S. PATENT DOCUMENTS

| | | | |
|---|---|---|---|
| 2,148,178 | 2/1939 | Shropshire | 366/171.1 |
| 2,960,318 | 11/1960 | Calillaud | 366/171.1 |
| 2,965,362 | 12/1960 | Flottmann | 366/171.1 |
| 3,293,117 | 12/1966 | Pennington, Jr. | 366/171.1 |
| 3,525,504 | 8/1970 | Colwell | 366/168.1 |
| 4,288,288 | 9/1981 | Fleck | 366/168.1 |
| 4,339,206 | 7/1982 | Ahs | 366/307 |
| 4,416,548 | 11/1983 | Carre | 366/171.1 |
| 4,577,974 | 3/1986 | Prough | 366/307 |
| 4,820,381 | 4/1989 | Brown | 162/57 |
| 4,908,101 | 3/1990 | Frisk et al. . | |
| 4,915,509 | 4/1990 | Saver | 366/171.1 |
| 5,088,831 | 2/1992 | Reinhall | 366/171.1 |
| 5,263,774 | 11/1993 | Delcourt | 366/307 |
| 5,466,334 | 11/1995 | Fredriksson | 366/171.1 |

FOREIGN PATENT DOCUMENTS

| | | |
|---|---|---|
| 1192694 | 6/1989 | Canada . |
| 1400173 | 4/1965 | France . |
| G 8807080 U | 5/1988 | Germany . |
| WO 93/04772 | 3/1993 | WIPO . |
| WO 93/07961 | 4/1993 | WIPO . |

OTHER PUBLICATIONS

International Tech. Disclosures, Jul. 1983, vol. 1, No. 9.

*Primary Examiner*—Randall Chin
*Attorney, Agent, or Firm*—Nixon & Vanderhye P.C.

[57] ABSTRACT

A method and apparatus allow large volumes of gas (at least about 10% by volume) to be mixed into a cellulosic fiber suspension having a consistency of about 8–25%. The mixing of ozone containing gas into the suspension is particularly desirable. The suspension is passed into the inlet of a mixer, gas is introduced into the mixer, and the gas and fiber suspension are homogenized by fluidizing the gas and suspension. The flow of suspension through the mixer is throttled so that the effect of the fluctuation and pressure between the inlet and outlet is minimized, and the homogeneously mixed gas and fiber suspension mixture is discharged from mixer outlet. The mixer may have a premixing zone in which the gas and suspension are fluidized to the floc level and the gas is evenly distributed throughout the suspension, then a homogenization zone in which the fiber suspension is fluidized to fiber or microfloc level and the gas is brought into contact with each fiber or microfloc, and then a maintenance zone in which the fluidization level is maintained high enough to prevent the generation of gas bubbles and the separation of gas from the suspension.

40 Claims, 12 Drawing Sheets

METHOD AND APPARATUS FOR MIXING GASEOUS CHEMICAL TO FIBER SUSPENSION

This is a continuation of application Ser. No. 08/377,745, filed Jan. 25, 1995, now abandoned.

BACKGROUND AND SUMMARY OF THE INVENTION

The invention relates to a method and apparatus that are specifically designed to mix large amounts (i.e. at least about 10% by, volume) of gas into a cellulosic fiber suspension (paper pulp), particularly medium consistency fiber suspensions. The invention is particularly applicable to the mixing of ozone gas with a fiber suspension to effect bleaching since the reactant ozone gas can be provided only in relatively small percentages of the amount of gas added to the suspension because of the need to entrain the ozone gas in a carrier gas (such as oxygen or air).

In the bleaching of medium consistency cellulosic fiber suspension, that is pulp having a consistency of about 8–25% solids, and typically about 10–15%, during the practice of ozone bleaching the pulp medium typically contains approximately 40–80% fiber suspension and approximately about 60–20% gas, more typically 50 to 70% fiber suspension and 50 to 30% gas. To evenly feed such a large volume of gas into a medium consistency cellulosic fiber suspension while achieving homogenous mixing is difficult since the gas tends to separate from the suspension due to local pressure differentials. This results in increased chemical usage (typically ozone usage, although the invention is also applicable to other gaseous mediums such as hydrogen peroxide). Present bleaching facilities also have difficulties —when utilizing such large volumes of gas— with uneven bleaching and poor process runnability.

A number of known mixers are used for mixing ozone into pulp. Some of these mixers have previously been used for mixing liquid chemicals as well as for mixing gaseous chemicals. Typically, the mixers are efficient only when mixing relatively small gas volumes. Such mixers have operated satisfactorily with several gaseous chemicals used in bleaching. Attempts have also been made to use them for mixing ozone. It has been noted, however, that although a mixer has been able to satisfactorily mix small amounts of gas with a fiber suspension, the mixing of large amounts of gas, for example about 10% or more, has not been entirely successful. Several of the above mentioned mixers have been modified for mixing large gas amounts, but this has typically resulted in poor, or completely unsatisfactory, mixing results.

Another group of prior art mixers comprises more modern mixers especially designed for mixing large ozone gas volumes with pulp. Many of these have reached a point in development where prototypes have been brought to an operating mill and tested. The results have typically been more positive than with the previously known modified mixers. However, according to those who know the potential possibilities of ozone in the bleaching art, even the more modern ozone mixers do not operate more than satisfactorily in actual mills. A phase has thus been reached were the pulp mills are satisfied with the bleaching result achieved and the relation thereof to the investments required by the implementation of ozone bleaching.

Though generally satisfied with modern mixers for mixing ozone in a medium consistency pulp—at least to the extent that they are willing to implement medium consistency ozone bleaching practices in commercial mills—those in the art believe that the mixing process can be improved considerably, and optimized. It has been demonstrated that the mixing process presently utilized is not anywhere close to optimum efficiency either as far as chemical usage or homogeneity of the mixture are concerned. Homogenous mixing is particularly important when ozone gas is used as the bleaching medium because of the high reaction rate of ozone and its ability to attack the pulp fibers themselves if in too high a concentration at any particular locality in the suspension. Therefore it is desirable to increase the homogeneity of the mixing of gaseous bleaching mediums with pulp, particularity the mixing ozone and carrier gas with pulp, so as to minimize chemical (ozone) usage while maximizing homogeneity of treatment.

It has been determined in the tests performed that a characterizing feature of the mixers in accordance with the prior art is that the inlet pressure of the fiber suspension in the mixers, or more generally the pressure effect caused by the inlet opening, whether positive or negative, affects the mixing process. It has also been found that the pressure effect of the outlet opening for the fiber suspension also affects the mixing process. Further it has been found that the pressure variations caused by the inlet openings for the fiber suspension affect the outlet opening, and pressure variations at the outlet opening affect the inlet opening. The result thereof is that a portion of the gas flows very rapidly through the mixer. In a worst case scenario it may be assumed that the mixer has a channel through which a portion of the gas flows almost without any obstruction. Accordingly, a portion of the gas will remain in the mixer longer than the majority of the gases. This results in an uneven dosing of gas to different parts of the fiber suspension, which again leads to an undesirable lack of homogeneity. The reason for the above described phenomenon is that the fluidizing apparatus disposed in the mixer is not alone sufficient to prevent pressure variations through the apparatus.

Ozone is the most rapidly reacting bleaching chemicals used to bleach pulp. Moreover, ozone is the least selective, reacting with all reactive substances it encounters, even with substances it should not affect. In fact for these reasons ozone cannot be compared with any other bleaching chemicals. Therefore ozone must be led into contact with each fiber in a mixture fluidized almost at the fiber level. One cannot rely on diffusion, as with other bleaching chemicals, in which it is sufficient that the chemical is brought to a position within a short distance of a fiber floc of a reasonable size to find its way to the fibers by diffusion.

Ozone may be industrially manufactured only in relatively dilute mixtures. In other words, only about 5–14% (maximum about 20%) of the gas to be supplied for bleaching is ozone, the rest being "carrier gas", which is usually oxygen, air, or nitrogen, although other insert gases (at least insert compared with ozone) may be used. Thus, although relatively small ozone amounts are sufficient for bleaching, a carrier gas must be supplied and mixed with ozone which is typically about 5–20 times the amount of the ozone.

It is the primary object of the present invention to provide a method and apparatus which effect a greater homogeneity in the mixing of large volumes of gas, particularly ozone and carrier gas, in cellulosic fiber suspensions, particularly medium consistency (about 8–25%) fiber suspensions. Increased homogeneity is provided according to the present invention by fluidizing the gas in suspension to the fiber or microfloc level so that gas is brought into contact with each fiber or microfloc while throttling the flow of suspension through the mixer so that the effect of the fluctuation and pressure between the inlet and outlet of the mixer is minimized and therefore channelling is avoided.

According to one aspect of the present invention a method of mixing large volumes of gas into a cellulosic fiber suspension having a consistency of about 8–25% and a physical device having an inlet and outlet is provided. The method comprises the following steps: (a) Passing a cellulosic fiber suspension having a consistency of about 8–25% into the inlet of the physical device. (b) Introducing gas comprising at least about 10% by volume of the suspension into the physical device. (c) Homogenizing the gas and fiber suspension in the device by fluidizing the gas and suspension to produce a homogenized mixture. (d) Throttling the flow of suspension through the device so that the effect of the fluctuation in pressure between the inlet and outlet of the device is minimized during the practice of step (c). And, (e) discharging the fiber suspension with homogeneously mixed gas, comprising at least about 10% by volume of the suspension, from the outlet of the device.

Step (c) is typically practiced by (c1) first premixing the gas and suspension by fluidizing the suspension to floc level, and evenly distributing the gas throughout the suspension; then (c2) effecting homogenization by fluidizing the fiber suspension to fiber or microfloc level and bringing the gas into contact with each fiber or microfloc; and then (c3) effecting reaction maintenance by maintaining the fluidization level high enough to prevent the generation of gas bubbles and to prevent the separation of gas from the suspension. The physical device typically comprises a mixer having a rotatable rotor, and step (c) is practiced by effecting rotational movement of the fiber suspension utilizing the rotor, and steps (c1)–(c3) (typically step (c2)) are/is practiced by decelerating the rotor to effect deceleration of the mixture during the entire course of steps (c1)–(c3), or (c2). During the practice of step (c) at least one of steps (c1) through (c3) is practiced so that the mixing of gas with the suspension is intensified and separation of the gas from the suspension is made more difficult by bringing the suspension to a rotational movement around the blades of the rotor.

Typically the mixer has a housing internal wall with ribs, and the ribs may be provided with gaps therein. In this case there is the further step of passing part of the suspension through the gaps in order to make separation of gas from the suspension behind the ribs lo more difficult. Step (c) is typically practiced to effect mixing at a power $P_{tod}$, where:

$P_{tod}=K^* (1-P_g/100) *P_{teor}$, and where $P_g$=amount of gas in the suspension as a vol- % ;

$P_{teor}$=power required for mixing of gas-free pulp; and

K=a predetermined constant ranging from 0.9 to 1.0 (e.g. 0.95–1.0).

Step (b) is typically practiced by introducing a sufficient volume of gas into the suspension so that the mixture discharged during step (e) contains about 40 to 80% cellulose fiber suspension and about 60–20% gas, by volume; typically a sufficient volume of ozone gas in a carrier gas is introduced in step (b), the ozone comprising about 5–20% by volume of the total amount of gas introduced, into the suspension so that the mixture discharged in step (e) contains about 50–70% cellulose fiber suspension and about 50–30% ozone gas and carrier gas, by volume.

The invention also relates to an apparatus for mixing large volumes of gas into a medium consistency fiber suspension. The apparatus comprises the following components: A mixer casing having first and second ends, at least one suspension inlet conduit and at least one suspension outlet conduit. A rotor mounted for rotation in the casing, and a shaft connected to the rotor. Means for driving the rotor shaft. Means for introducing gas into the casing to mix with the fiber suspension to form a mixture of gas and fiber suspension. And, an intense mixing zone in the casing comprising means for both throttling the flow of suspension through the casing from the inlet to the outlet and homogenizing the mixture of gas and fiber suspension in the casing. The means for both throttling the flow of suspension and homogenizing the mixture comprises at least one throttling ring or like throttling element mounted on one of the rotor and mixer casing, a plurality of mixing members cooperating with the at least one throttling element.

The invention also relates to an apparatus which comprises the following elements: A mixer casing having first and second ends, at least one suspension inlet conduit and at least one suspension outlet conduit. A rotor mounted for rotation in the casing, and a shaft connected to the rotor. Means for driving the rotor shaft. Means for introducing gas into the casing to mix with the fiber suspension to form a mixture of gas and fiber suspension. And, an intense mixing zone in the casing comprising at least one throttling element for throttling the flow of fiber suspension through the casing.

The invention also relates to a centrifugal pump for pumping of gaseous liquids and suspensions. The pump comprises: A suction channel having an intense mixing zone. A rotor located in the suction channel. An impeller. And, means for throttling the flow of and homogenizing the mixture of gas-fiber suspension, the means located in the intense mixing zone.

Figure 16A:
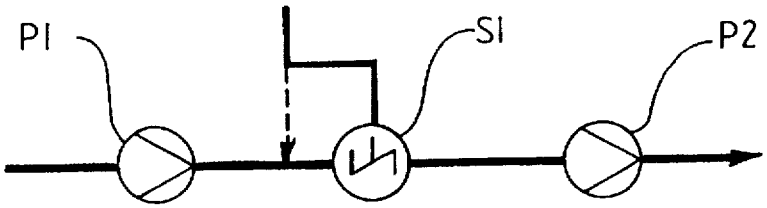
Figure 16B:
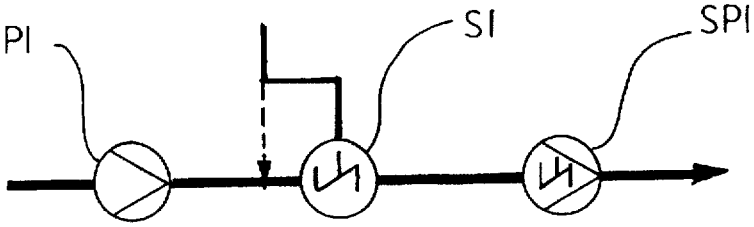
Figure 15:
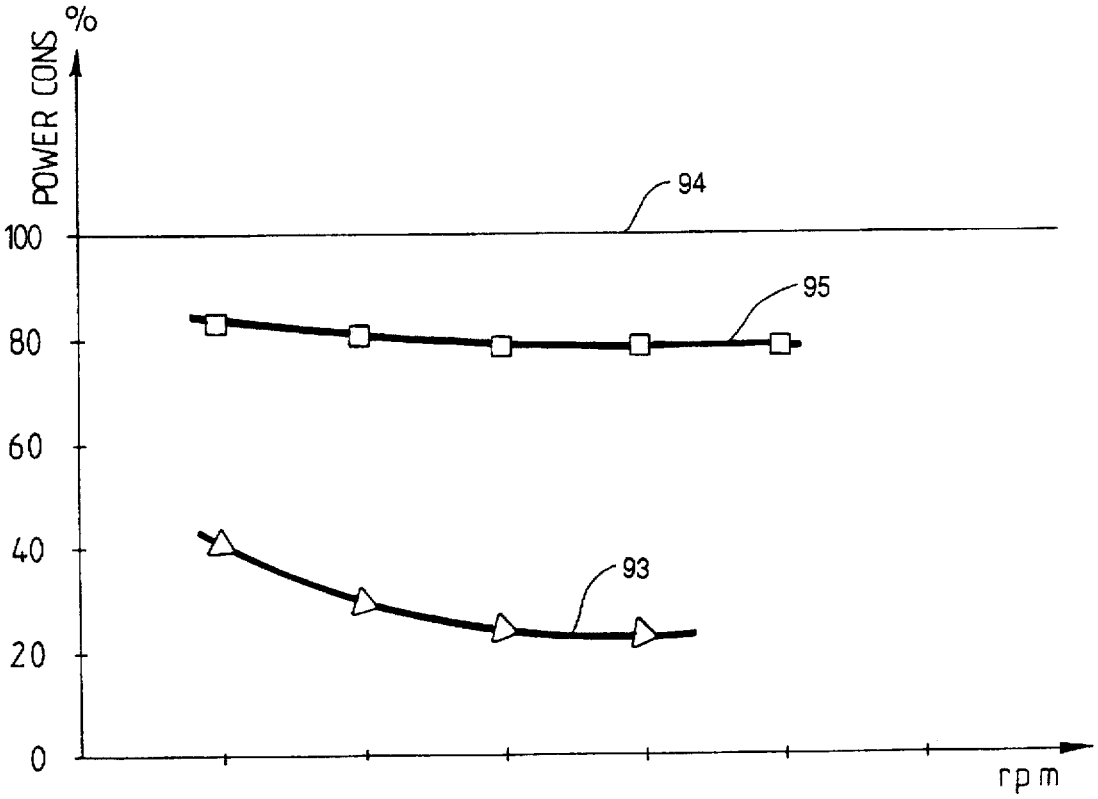
Figure 17:
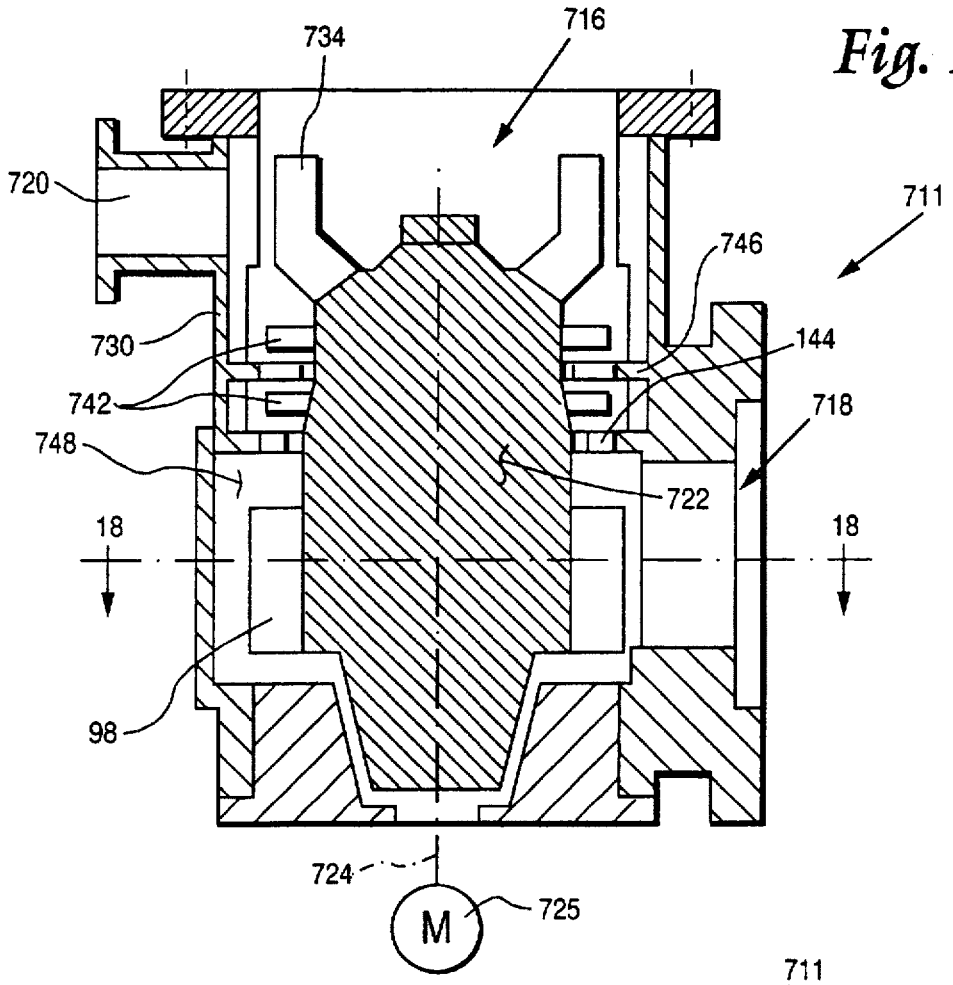
Figure 18:
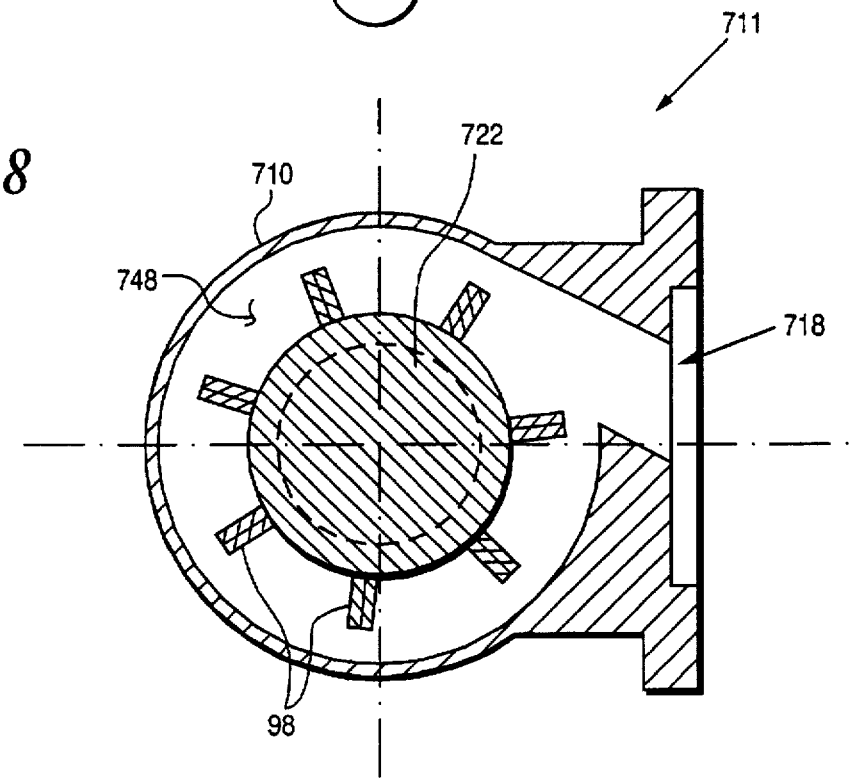

FIGS. **14*a*–14*c*** are schematic illustrations of the operation of various configurations of blades having openings therein, according to the present invention;

FIG. 15 is a graphical illustration of the difference in power consumption due to the gas content of the pulp comparing apparatus according to the present invention and apparatus according to the prior art as a function of rotational velocity of the apparatus; FIGS. 16*a* and 16*b* schematically illustrate two different assemblies of apparatus according to the present invention for practicing the method according to the invention; and FIGS. 17 and 18 are, respectively, side and top crosssectional views of a centrifugal pump embodiment of apparatus according to the present invention.

DETAILED DESCRIPTION OF THE DRAWINGS

Figure 1:
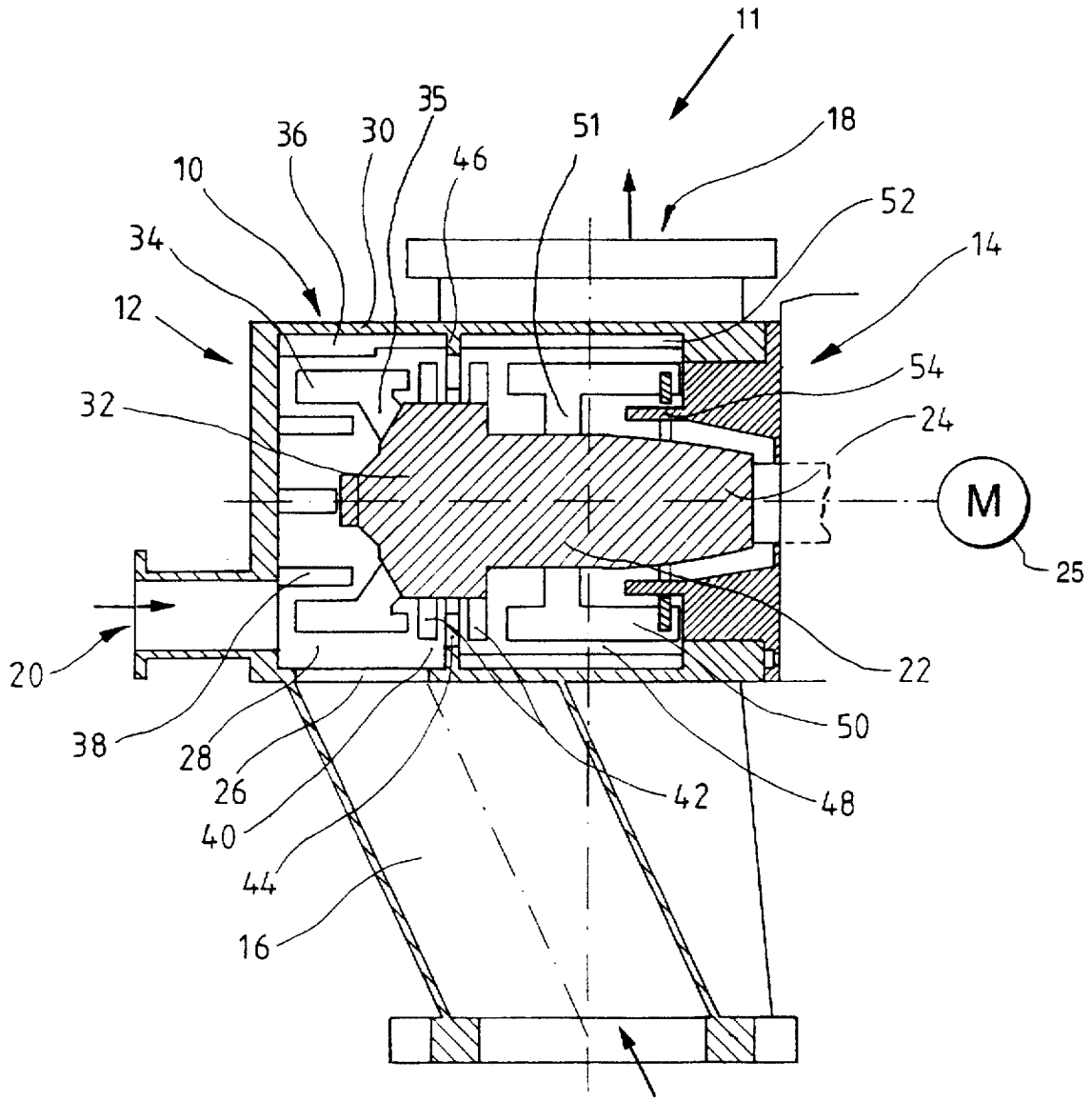
FIG. 1 schematically illustrates a side view, partly in cross-section and partly in elevation, of a first embodiment of exemplary apparatus according to the present invention.

FIG. 1 illustrates a mixer 11 in accordance with a preferred embodiment of the invention, comprising an elongated primarily cylindrical mixer casing 10 having first and second ends 12 and 14, an inlet conduit 16 in the casing for incoming fiber suspension, and an outlet conduit 18 for outflowing fiber suspension/gas mixture. Reactant gas (e.g. 5–20% ozone in a carrier gas such as $O_2$, $N_2$ or air) is introduced into the casing 10 via inlet 20, and a rotor 22 is rotatably mounted inside the casing 10 through the end 14. The rotor 22 comprises blades 34, 50 and mixing members 42 mounted in a suitable manner, preferably via arms 35, 51, to a shaft or hub 24. The shaft or hub 24 of the rotor 22 is connected to conventional drive means such as the motor shown schematically at 25, and capable of rotating the rotor 22 at fluidizing speeds (e.g. greater than 1000 rpm).

The fiber suspension to be treated in the embodiment of FIG. 1 is supplied either radially or tangentially to a first mixing chamber 28, comprising a premixing volume or zone, through an opening 26 in the wall of the casing 10 connected to inlet conduit 16. The gas (e.g. ozone in carrier gas) to be mixed is brought into chamber 28 in the FIG. 1 embodiment through the inlet conduit 20 at the end 12 of mixing casing 10. The gas feed conduit 20 may also be provided in the circumferential wall 30 of the casing 10 (shown by reference numbers 120 and 130, for example, in FIG. 2) Alternatively, or in addition, the gas feed coduit 20 could be connected. The only thing that must be taken into account is that ozone-containing gas is not supplied at such an early point to the pulp that a substantial portion of the ozone gas could be consumed before it is efficiently mixed with pulp, whereby there would be a risk that a portion of the fiber suspension could be over-exposed to ozone, in other words, the fibers could deteriorate.

The tip 32 of the rotor 22 preferably extends to a certain extent into the premixing volume 28, in which the blades 34 at the tip 32 generate an intense fluidization of the fiber suspension, so that the large fiber flocs of the suspension are broken and the supplied gas is evenly distributed within the whole premixing volume 28 to the spaces between the small flocs. The wall 30 of the premixing chamber 28 is preferably provided with ribs 36 which function to prevent excessive rotation of the fiber suspension by the blades 34 of the rotor 22. Preferably the ribs 36 extend throughout the whole length of the apparatus 11, but possibly having different heights in different zones of the mixer 11. It is possible to add stationary mixing members 38 to the end 12 of the casing 10; the only purposes of the members 38 are to add to the turbulence of the pulp in the premixing chamber 28 and to prevent excessive rotation of the pulp under the influence of the rotor 22. The mixing members 38 of the end 12 are preferably located radially inside the blades 34 of the rotor 22 spaced therefrom. Both the blades 34 of the rotor and the ribs 36 at the wall 30 of the casing 10 are preferably substantially axial, however fluidizing members having some other orientation are also possible.

If required, the blades 34 of the rotor 22 may be made to feed some fiber suspension to the zone following chamber 28. What is more important than the direction of the ribs 36 and the blades 34 is the distance between the blades 34 and the ribs 36 and the other dimensions thereof, by means of which the fluidization level of the premixing volume 28 is adjusted to optimize mixing homogeneity. Features affecting the required fluidization level are, for example, the amount of fiber suspension to be treated (e.g., tons/hour), the consistency of fiber suspension (e.g. 10–15%), the volume of gas to be mixed (at least about 10% by volume, typically about 20–60% by volume, optimally about 30–5% by volume), and the origin of the fibers. Since the above mentioned factors provide various combinations, no generally applied dimensions or dimensioning principles are given.

The tip portion 32 of the rotor 22 is, for example, conical so that when the surface of the rotor 22 turns the pulp is directed to a fluidization, or "homogenization" zone 40. Mixing in the zone 40 is more intense than in the previous zone 28, and the flow velocity of the fiber suspension is at its greatest due to a smaller cross-sectional flow area. In the zone 40 the mixture of the fiber suspension and gas is fluidized so efficiently that practically speaking all fiber flocs in the suspension are broken into small microflocs, containing only a few fibers each. This allows the gas to be distributed very evenly throughout the entire mixture. In the high turbulence zone 40, gas is so well mixed on the surface of the micro flocs that the gas consumption as a function of brightness is minimized, and at the same time all the micro flocs and the fibers therein are equally and evenly treated by the reactant chemical (e.g. ozone).

The extremely intense fluidization in the homogenization zone 40 is brought about by means of cogs 44 mounted on the wall. 30 of the casing 10, and preferably radial pins 42 on an exterior surface of the rotor 22. The shape of the pins 42 is preferably round and radial, but members having rectangular or polygonal cross-sectionals, or even of pyramid shape, may also be used. Both the pins 42 and the cogs 44 may have a similar shape. FIG. 1 illustrates two substantially circumferential rows of pins 42 on the surface Qf the rotor 22 and one cogged ring 46 located therebetween on the wall 30 of the casing 10. Of course, the nuniber of both the pins 42 and the cogged rings 46 may deviate from the above description. Preferably, the pins 42 and the adjacent cogged rings 46 are positioned in such a way that they are interlacing. The same applies also to the cogs 44, if there are more than the illustrated one cogged ring 46. Preferably, each of the cogged rings is formed of a continuous ring 46 provided on the wall of the casing 10, and of cogs 44 extending inwardly towards the axis. Thus, the flow of suspension/gas mixture is throttled at the cogged ring 46. The nmnber of both the cogs 44 and the pins 42 in each ring varies according to the size of the apparatus from two to fifteen.

It is also possible to throttle the flow in the homogenization zone 40 by providing the pin ring of the rotor 22 to begin from an annular flange arranged on the rotor 22 surface and radially extending towards the wall 30 of the mixer casing 10.

By utilizing mixture flow throttling as described above, it is possible to prevent pressure variations of the inlet 16 and outlet 18 from affecting each other. By forcing the fiber suspension flow through a small enough flow channel it is ensured that the mixing process in the homogenization zone 40 is optimal, so that the gas is distributed evenly to the entire fiber suspension. The operation of the throttling effect illustrated in FIG. 1 is as follows: Striving towards the maximization of the shear forces relative to volume, a large number of pins 42 and cogs 44 are provided on the walls of the rotor 22 and the casing 10 in the embodiment of FIG. 1. In so doing, a preferred three-dimensional turbulence field is created. In practice, this means that at the same time that the pins 42 of the rotor 22 tend to rotate the fiber suspension circumferentially, the first pins in the flow direction of the fiber suspension "throw" the fiber suspension against the wall 30 and the counter ribs 36. In order for the suspension to axially flow forward the flow must, to avoid the throttling, move towards the axis. From the axis, after passing the throttling elements, the fiber suspension is again thrown, due to a second set of pins 42, against the wall 30 and counter ribs 52 of the casing 10. If there is a second cogged ring 46 after the first one, this forces the flow against the centrifugal force towards the shaft 24 of the rotor 22. Thus the fiber suspension is forced by pins 42 and counter ribs 36 to radial and axial movement as well as circumferential movement, so that, due to the pulse-like force effects caused by these elements, a three-dimensional turbulence field is generated.

The homogenization zone 40 is followed by a zone of weaker turbulence, i.e. a "maintenance zone" 48, which may also be called a "reaction zone" or "discharge zone". The diameter of the rotor 22 in zone 48 of the embodiment of FIG. 1 is substantially smaller than at the homogenization zone 40, and the rotor 22 is provided with blades 50 in zone 48. The wall 30 of the casing 10 at the maintenance zone 48 is preferably provided with ribs 52, which extend radially inwardly from the wall 30 a distance smaller than the corresponding ribs 36 of the premixing zone 28. The purpose of the zone 48 is to maintain a sufficient turbulence or fluidization level in the fiber suspension so that the already mixed-in gas does not separate, but rather continues to react, which is made possible by the even distribution of gas in the homogenization zone 40 almost to the fiber level. Another purpose of the maintenance zone 48 is to accelerate the rotational velocity of the mixture formed by the fiber suspension and gas so that the mixture may be removed from the apparatus 11 preferably through one tangential outlet conduit 18. However, the rotational velocity must be maintained at a high enough level so that the gas does not separate around the rotor 22.

The separation tendency of the gas may be made more difficult by providing stationary blades 54 extending preferably axially in the maintenance zone 48 between the blades 50 and the surface of the rotor 22. When the fiber suspension has received an appropriate kinetic velocity by the blades 50 and when the discharge conduit 18 is correctly designed, the fiber suspension—gas mixture is discharged from the mixer 11 in such a way that gas does not separate, but the bleaching chemical in the residual gas may without any hindrance continue the reaction in an exhaust pipe connected to outlet 18, and/or in a bleaching reactor following it, if such a reactor is necessary. A separate bleaching reactor is according to the modern technology typically not necessary when using ozone as the bleaching chemical. In some cases, however, a considerable extension of the reaction zone is required, which results in additional consumption of energy, if a sufficient turbulence level is desired to be maintained so as to eliminate the separate of gas.

It is a significant feature of the entire construction described above that the basis of the construction has been to minimize the size of the areas where gas separation is likely, and if it has been necessary to leave such places in the apparatus to minimize the effect thereof by preventing the flow of the gas in the axial direction of the apparatus. In other words, the channelling tendency of the separated gas, i.e. the flow along a path from the gas inlet or separation point to the discharge of the pulp, is eliminated, or at least minimized. Elements designed to achieve this purpose illustrated in FIG. 1 are, for example, blades 34 and 50 (see FIG. 1), ring 46(see FIG. 1), and an annular flange (not shown) associated with pins 42.

It is a significant feature of the blades 34 and 50 that they are not mounted to the rotor 22 throughout the entire length thereof, but rather-by way of spaced arms 35, 51. The purpose of this construction is to prevent the formation of a large gas bubble behind the trailing side of a blade 34, 50 and/or arm 35, 51 of the blade. In the embodiment of FIG. 1, only a very small gas bubble will form behind the arms 35, 51 of the blades 34, 50. Further, due to the free space between the blades 34, 50 and the hub or the rotor body of the is rotor 22, the pulp flow will rotate the blade so that hardly any gas will accumulate behind the blades 34, 50. In the embodiments described below the accumulation tendency of the gas is decreased even more. The throttling ring 46 prevents the gas accumulated behind the counter ribs 36 from flowing along the ribs 36 towards the outlet 18 for pulp. The ring 46 forces the gas towards the rotor 22, so that the intense turbulence generated by the pins 42 breaks the gas bubbles and mixes them evenly with the pulp. Similarly, the annular flange optionally associated with the pins 42 on the side of the rotor 22 prevents the movement of any gas bubble generated axially around the rotor towards the pulp discharge by forcing any generated bubble radially outward, so that intense turbulence mixes the gas evenly with the pulp.

Yet another feature disturbing the gas separation tendency is the construction of the rotor 22 itself, or more accurately the existence of the rotor body. When transferring a fiber suspension in a fluidizing apparatus provided with a rotatable rotor in the axial direction from an inlet opening 16 towards the outlet opening 18, the pulp tends to rotate with the rotor along the rim of the apparatus regardless of, whether or not stationary ribs are provided on the rim. The rotational movement of the pulp again tends to separate gas to the center of the flow, so that a natural way of preventing the accumulation of gas is to construct the rotor such that it fills the volume, to which the gas could otherwise separate. Therefore in the illustrated embodiments both in the homogenization zone 40 and in the maintenance zone 48 the rotor 22 body is relatively thick, leaving only a limited space between itself and the wall 30 of the casing 10. In the premixing chamber 28 the center of the rotor 22 is practically speaking open, since in most cases the rotational movement of the pulp has not yet had time to accelerate to such an extent that gas would begin to separate. On the other hand, large amounts of gas are fed to the premixing chamber 28, so that the gas is in the form of large bubbles without being evenly distributed in the fiber suspension. Thus the arrangement of a rotor 22 body extending from the inlet end 12 throughout the entire apparatus 11 would not be justified.

In subsequent FIGS. components comparable to those already described are shown by the same two digit reference designation preceded by another number (e.g. "1" to "2").

Figure 2:
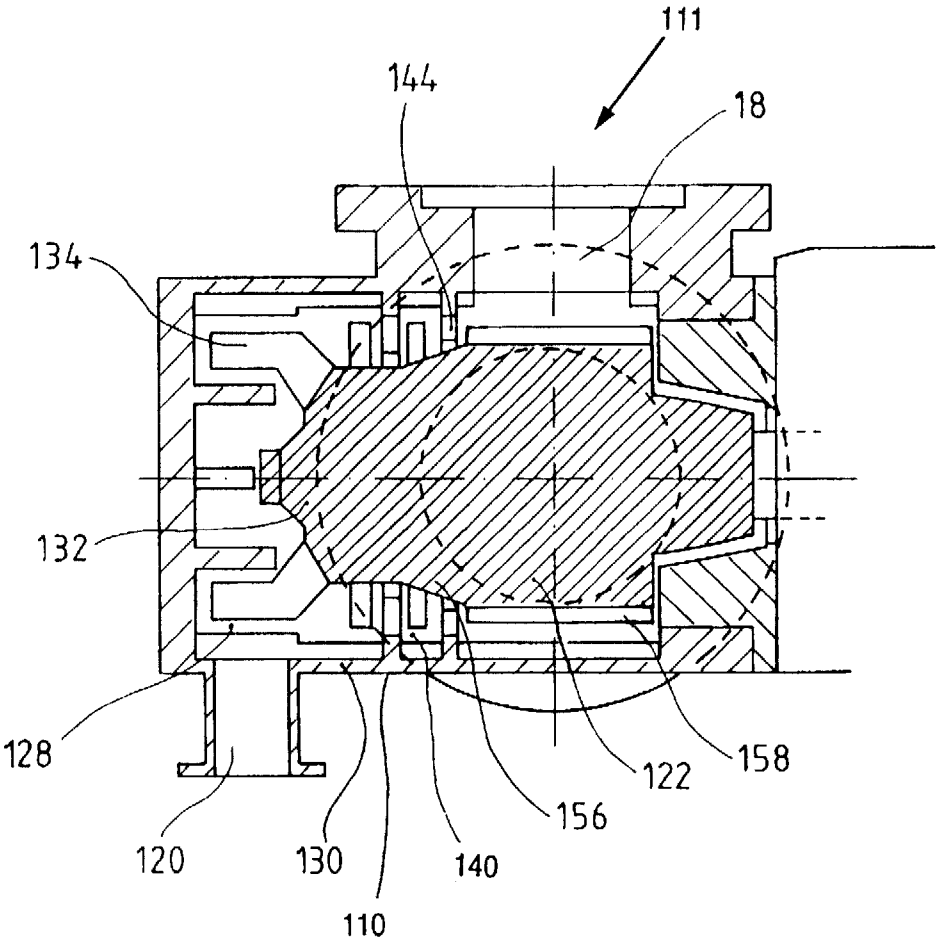
FIG. 2 is a schematic top view, partly in cross-section and partly in elevation, of a second embodiment of apparatus according to the invention.

FIG. 2 illustrates a mixer 111 in accordance with a second embodiment of the invention. The diameter of the rotor 122 of the mixer 111 is not decreased after the homogenization zone 140, but it is increased by means of an intermediary part 156 so that at the outlet opening 118 the diameter of the rotor 122 is relatively large, and the surface of which rotor 122 is provided with ribs 158 in order to maintain the turbulence level high enough to maintain the gas evenly distributed throughout the entire suspension. A second cogged ring 144 is located at the conical intermediary part 156, the cogs of which do not have to extend too far into the homogenization zone 140. The blades 134 at the tip 132 thereof have a form slightly deviating from the embodiment of FIG. 1. In other words, the extensions of the blades 134 extending towards the homogenization zone 140 from the mounting point of the blades 134 have been left out. Of course, different variations illustrated in FIG. 2 may be applied separately without any need to use them all in the manner illustrated in FIG. 2. FIG. 2 also illustrates that an inlet conduit 120 for gas may be in the wall 130 of the mixer 111 casing 110 and that the inlet opening for pulp (not shown, but extending into the plane of the paper illustrating FIG. 2) may also be at an angled position relative to the outlet opening 18 (a 90° angle is shown).

A combination of embodiments in FIGS. 1 and 2 may be provided in which the rotor 22 is practically speaking similar to that of FIG. 1 and the casing 110 partially similar to that of FIG. 2. The wall of the casing 110 may have two cogged rings, which operate as already mentioned above, in other words, one of the cogged rings, 144, directs axial flow towards the rotor, which results in a situation in which the incoming flow passes along the surface of the rotor in the reaction zone 48 until the end of the apparatus, rises there due to the centrifugal force to the rim of the casing and is only there able to be discharged from the apparatus. By this operation model—throttling—it is essentially ensured that no part of the flow can pass directly from the premixing zone to the pulp discharge; in other words channelling of the pulp is prevented, but the pulp must circulate one cycle in the reaction zone. This increases the retention time of pulp in the apparatus so that there will be enough time to essentially completely carry out the ozone bleaching reaction in the apparatus 11, 111 itself.

Figure 3:
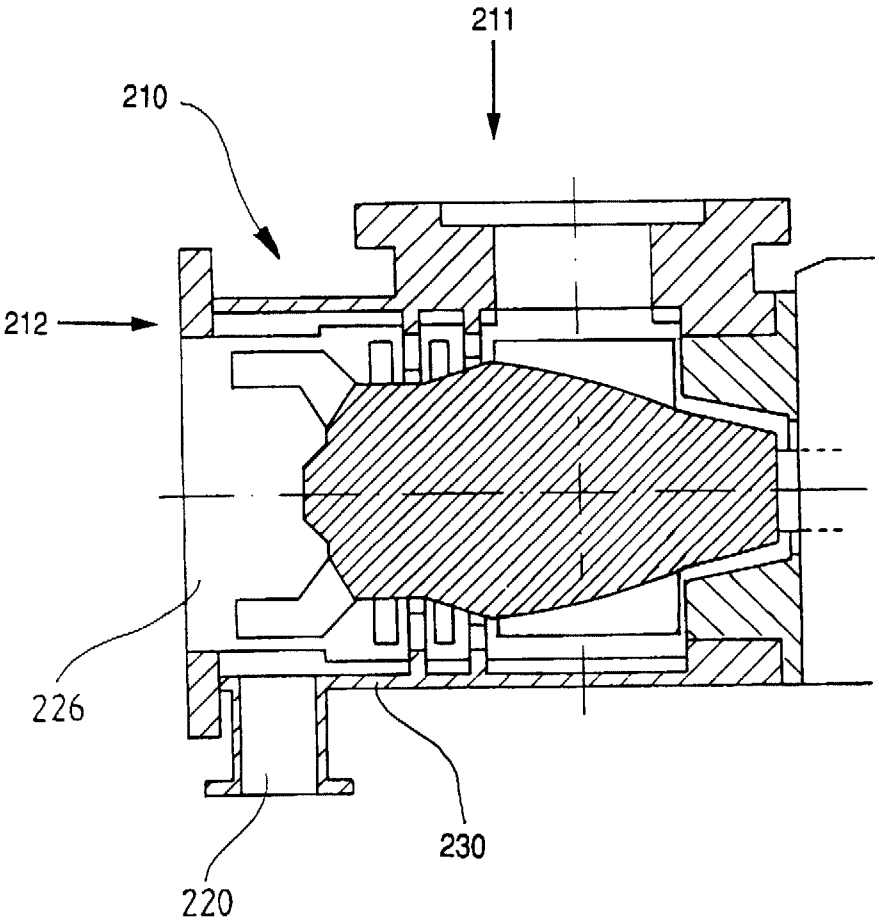
FIG. 3 is a view like that of FIG. 2 of a third embodiment.

FIG. 3 illustrates a mixer 211 in accordance with a third embodiment of the invention, which may have a construction similar to that of either FIG. 1 or FIG. 2, or variations thereof, but having an inlet opening 226 for fiber suspension that is axial, while the inlet conduit 220 for gas is radial. In other words, the inlet opening 226 for fiber suspension is preferably located in the first end 212 of the casing 210 and the inlet conduit 220 for gas preferably to the wall 230 of the casing 210. Alternatively the inlet opening 226 may correspond to that of FIG. 1 so that the pulp is supplied from the inside of the stationary mixing members 38 of the FIG. 1 embodiment.

Figure 4:
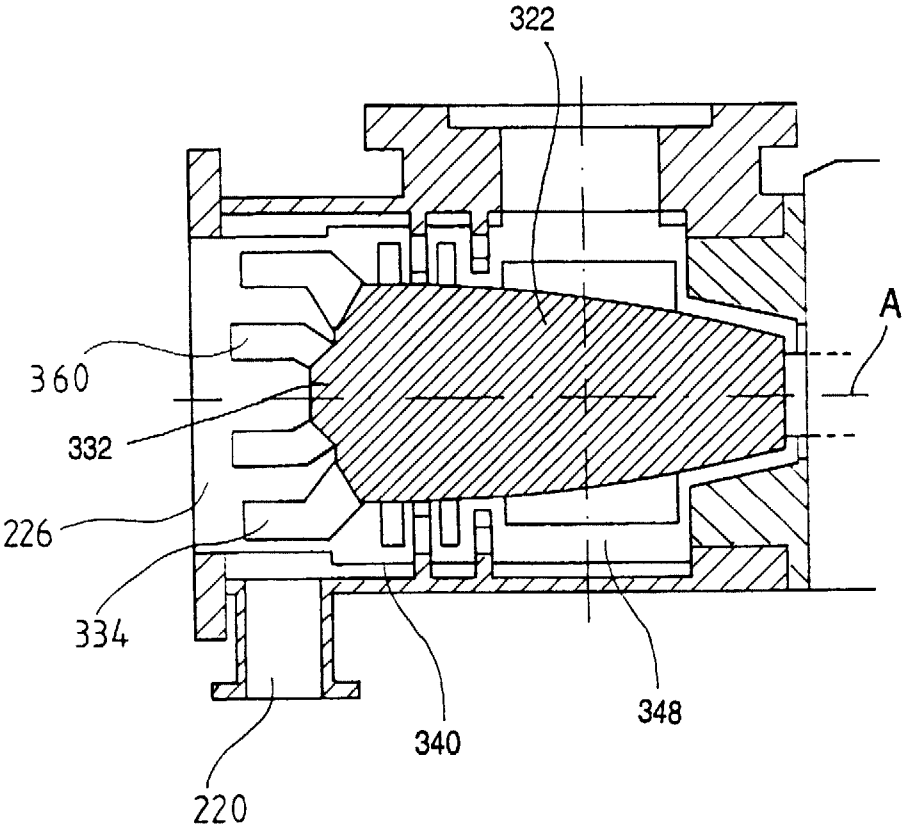
FIG. 4 is a view like that of FIG. 2 of a fourth embodiment.

FIG. 4 illustrates another alternative to the tip portion 332 of the rotor 322 illustrated in the previous drawings, which tip portion 332 has mixer blades 360 extending almost to or even with the axial line A in addition to the blades 334 parallel to but radially spaced from the axis A. FIG. 4 also illustrates a diameter of the rotor 322 that is substantially constant the entire length of the rotor 322, in other words constant in the homogenization zone 340 and maintenance zone 348. It is significant that the width of the blades 334 and 360 is relatively small compared to their radial dimension, so that no significant gas accumulation will form behind them. On the other hand, the form of the blades 334, 360 also enables circulation of pulp flow around them. Although gas could in theory separate to the inside of the blades 360 to open center of the rotor 322, that does not happen in practice since the centrifugal field required for separation of gas does not have time to generate.

Figure 5:
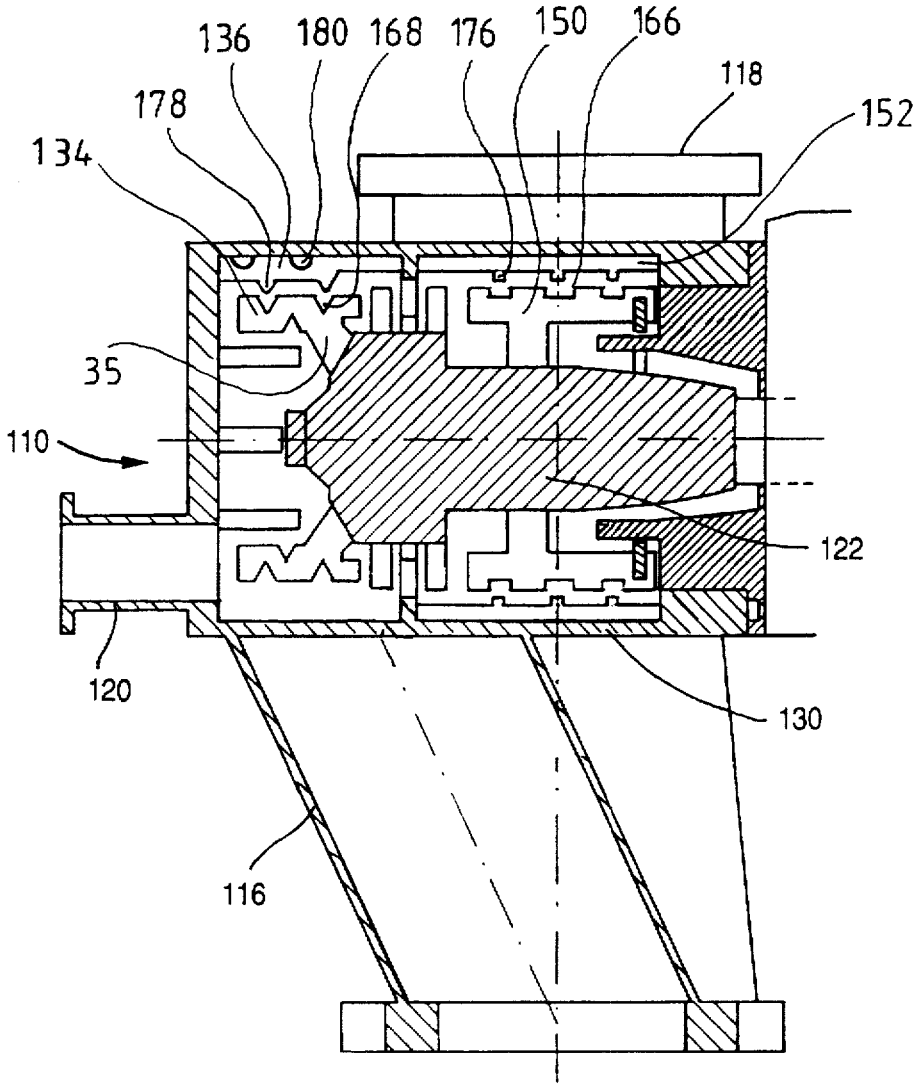
FIG. 5 is a view like that of FIG. 1 of a fifth embodiment.

FIG. 5 illustrates an embodiment alternative to that of FIG. 1, in which the edges of the blades 134 and 150 of the rotor 122 are provided with either triangular cuts 168 or rectangular or otherwise appropriately shaped cuts 166, the purpose of which is further to decrease the size of the gas bubble tending to accumulate behind the blades, 134, 150. The cuts 166 and 168 may be located only in the outer edge of the blades 134 and 150, or may extend to the ends and inner edge of the blades 134, 150. The cuts 166 and 168 generate microturbulence in the surrounding volume, which tends to break the gas bubble generated behind the blades 134, 150. Experimentation has shown that the optimization of the clearances between the rotor 122 and the counter members thereof is very important, the counter ribs 136 and 152 on the wall 130 of the casing 110 are preferably provided with protrusions 178 and 176 facing the cuts in the blades 134 and 150 of the rotor, said protrusions being shaped like the cuts 166, 168 of the rotor blades 134, 150. In this way the rotor blades do not rotate the pulp, but on the other hand differences in velocity are generated as efficiently as possible. It is, of course, possible to provide protrusions form the blades 134, 150 and respective recesses or constants the counter ribs 136.

In the FIG. 5 embodiment 136 the accumulation of gas is prevented and/or minimized behind the counter ribs 136 (or other stationarily mounted ribs). The bottom part of each rib 136, in other words the mounting line between the wall 130 and the rib 136 of the casing 110, is provided with perforations, openings or gaps 180, through which a pulp jet is discharged behind each rib 136 thus reducing the size of the gas bubble. More generally, it is sufficient to provide the rib 136 itself with some kind of flow opening, through which the fiber suspension is allowed to flow to the "back side" of the rib 136, regardless of whether the opening is limited either completely to the rib material or partially to the wall of the casing. This configuration is operationally identical with the embodiment in which a gap is provided between the hub of the rotor 122 and the rotor blades 134, 150.

Figure 6:
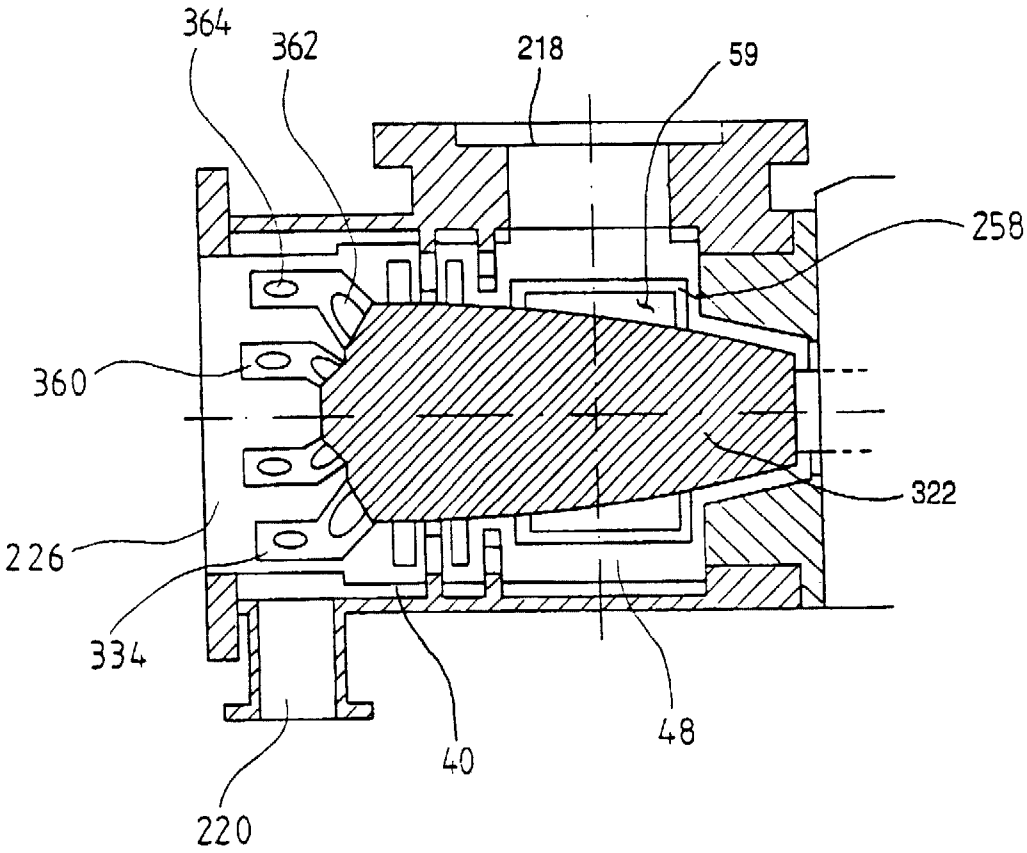
FIG. 6 is a view like that of FIG. 2 of a sixth embodiment.

FIG. 6 illustrates apparatus similar to that of FIG. 4, in which the blades 334 and 360 in the premixing zone of the rotor are provided with openings 362 and 364. Openings 362 are located at the connecting point between the rotor 322 and the blades 334, 360 and the openings 364 are further out on the blades 334, 360. The purpose of the openings 362, 364 is to prevent the accumulation of a gas bubble behind the blades 324, 360. FIG. 6 also illustrates a blade 258, which is in a way similar to the blade 50 of FIG. 1 in the sense that there is a gap 59 between the main part of blade 258 and the rotor 322, through which the fiber suspension is allowed to flow and thus prevent the generation of a large gas bubble. The pulp flow being discharged through the openings 362 and 364 decreases the gas bubble, which otherwise accumulates behind the blades 334, 360, to an insignificant size. The dimensions of the openings 362, 364 are important, since it is desirable to generate a flow circulation around each blade. A pulp jet discharged through an incorrectly dimensioned opening may completely prevent the generation of such a flow circulation.

Figure 7:
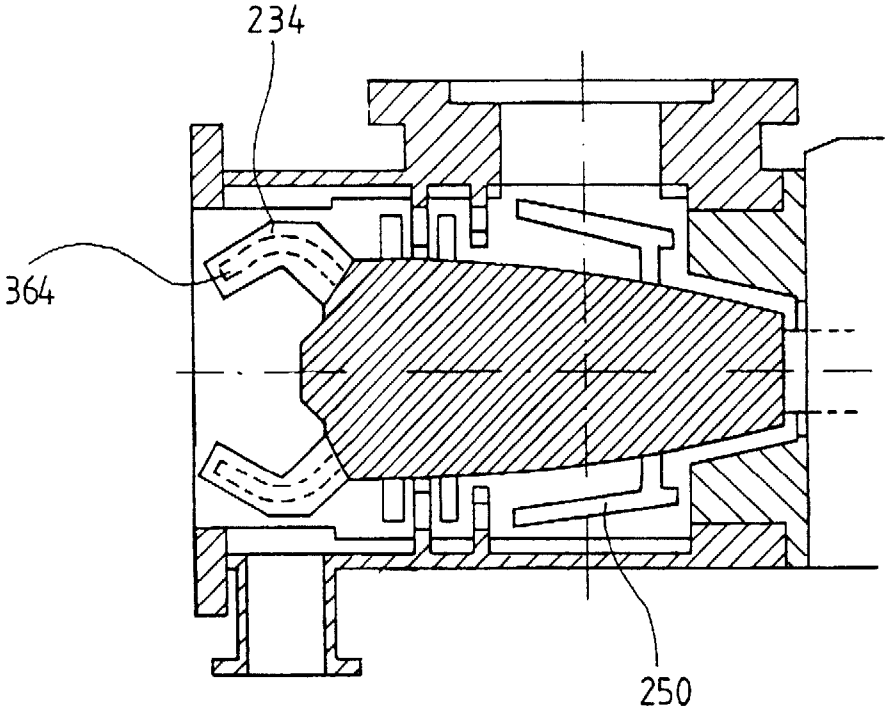
FIG. 7 is a view like that of FIG. 2 of a seventh embodiment.

FIG. 7 illustrates another rotor arrangement, in which the blades 234 and 250 are not axial, but they form an angle with the axis. FIG. 7 also illustrates (in dotted line) how an opening 364 in a blade 234 may extend almost throughout the whole length of the blade 234 from the bottom to the tip thereof.

Figure 8:
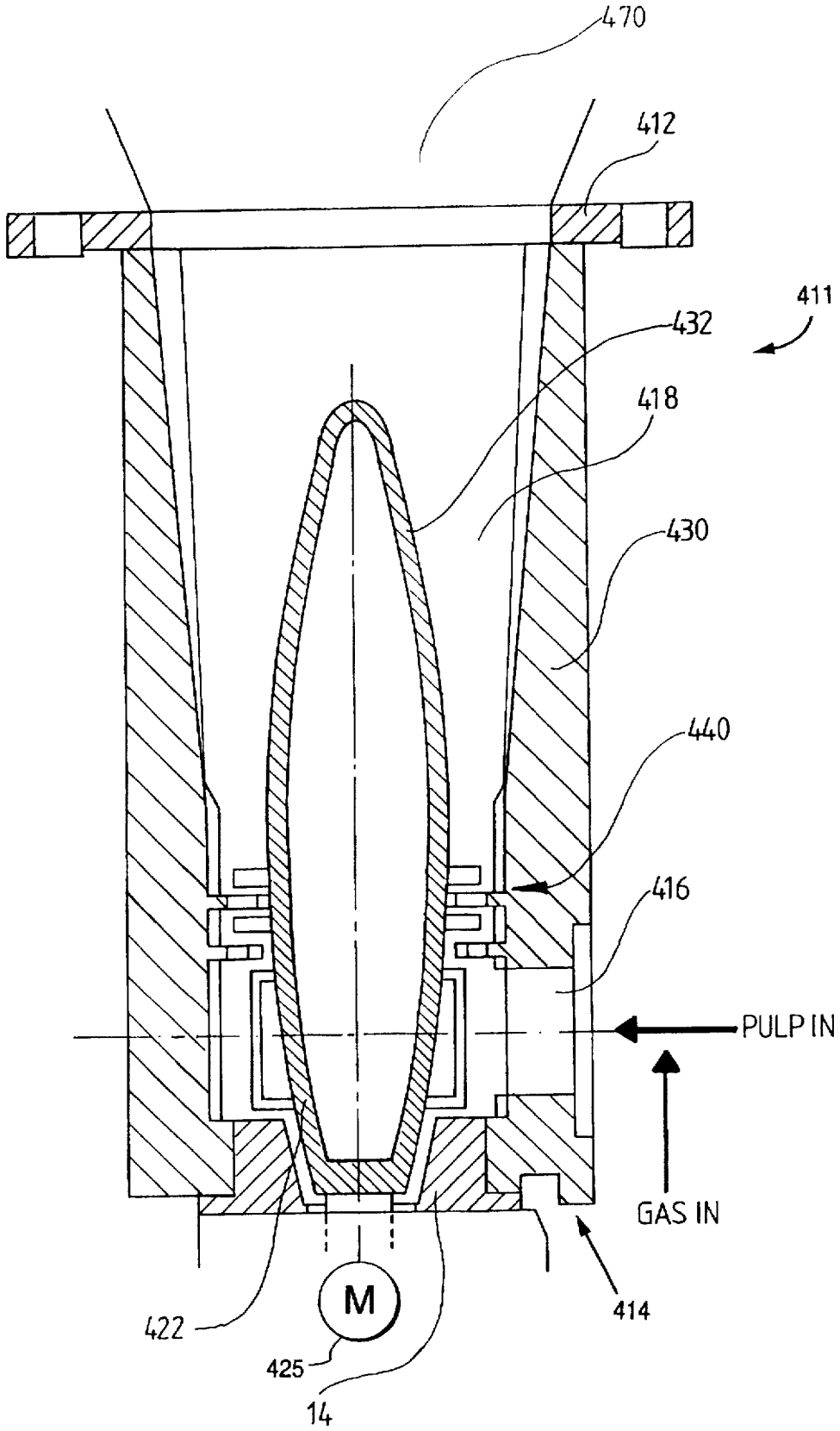
FIG. 8 is a schematic side view, partly in cross-section and partly in elevation, of an eighth embodiment of exemplary apparatus according to the present invention.

FIG. 8 illustrates an embodiment distinctly different from the embodiments illustrated in the previous drawings. The mixer of the embodiment of FIG. 8 illustrates firstly that a mixer in accordance with the present invention is vertical, so that the drive means 425 is located below the mixer. Pulp is supplied either radially or tangentially to the apparatus 411 at the end 414 of the mixer casing 430, in other words to a point where the rotor body encloses the center of the rotor 422. Pulp is supplied together with the chemical (e.g. ozone gas) to be mixed through the conduit 416. Further, unlike the previous embodiments, pulp is discharged from the apparatus axially, primarily according to the method illustrated in WO patent application 93/07961. The pulp in which the gas is evenly distributed in the homogenization zone 440, is discharged evenly, diminishing turbulence throughout the entire suspension to an axially extending discharge channel 418. The widening of the cross-sectional flow area of the discharge channel 418 may be made in principle in two ways, either by letting the flow channel widen by itself, for example, either conically or preferably parabolically, and/or by tapering the hollow rotor 422 tip 432. Preferably, the discharge channel 418 is further connected to a widening part 470 of the flow piping or to a specially designed reaction vessel. The purpose is to dampen the turbulence in the mixture of fiber suspension and gas so that the gas does not separate to any part of the flow, but remains homogeneously distributed in a laminar plug flow. Other details of the apparatus may be illustrated in other embodiments.

Figure 9:
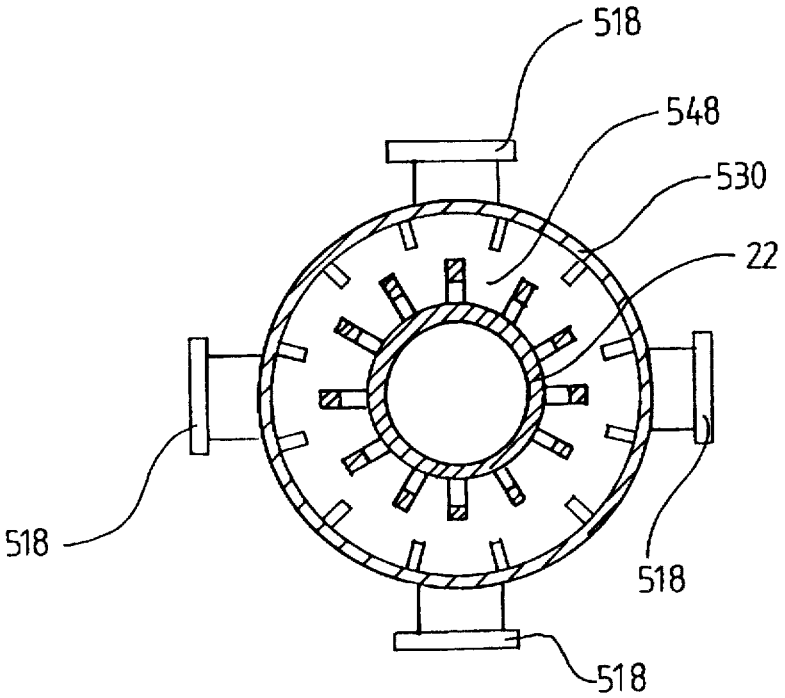
FIG. 9 is a top plan view, partly in cross-section and partly in elevation, of a ninth embodiment of apparatus according to the present invention.

FIG. 9 illustrates a distributing mixer. Based on the embodiment of FIG. 6 the reaction zone 548 of the mixer casing 530 is provided with four equally-spaced discharge conduits 518, although the number thereof may vary. Several discharge conduits 518 are required, for example, when pulp is desired to be passed to spaced part targets, or when it is desired to feed the pulp, for example, through four inlet openings located in the bottom of an oxygen or peroxide bleaching tower to prevent channelling in the bleaching tower.

Figure 10:
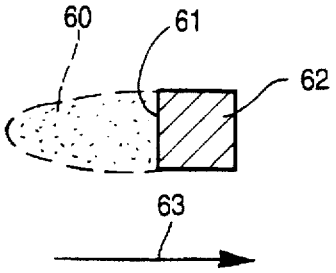
FIG. 10 is a schematic illustration of how gas accumulates on the trailing surface of a physical element moving through a suspension which contains gas.

FIG. 10 schematically illustrates how gas 60 attempts to accumulate in the flow forming a "tail" adjacent the trailing surface 61 of a movable object 62, regardless of whether it is a rotatable blade or an arm of a blade to be attached to a rotor. The arrow 63 indicates the direction of movement of the object 62 in the flow.

Figure 11:
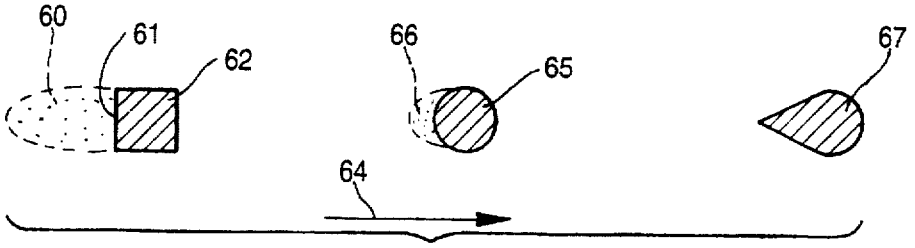
FIG. 11 is a view like that of FIG. 10 showing the differences in gas accumulation depending upon the shape of the trailing surface of the moving element.

FIG. 11 illustrates different cross-sectional alternatives for an arm of a blade. The arrow 64 views shows the direction of movement of an arm of a blade. The left arm 62 has the cross-section of a square, or at least of the shape of a rectangular prism. It causes a large gas accumulation 60 as shown in FIG. 10 at the trailing surface 61, but the arm 62 is most inexpensive to manufacture. The middle arm 65 is substantially round in the cross-section, so that the size of the gas bubble 66 accumulating behind it is considerably smaller than for the previous alternative. The cross-section of the rightmost arm 67 is drop-like, which allows hardly any gas to separate behind it, but rather is streamlined. When mounting a blade by using such a drop-shaped arm 67, it is possible to run the arm relative to its longitudinal axis so that the axis of symmetry thereof will be completely parallel to the resultant of the velocities of the blade and the flowing pulp.

Figure 12:
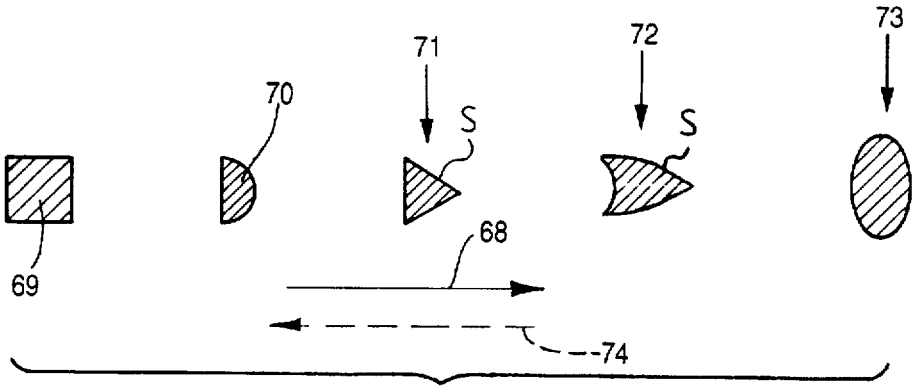
FIG. 12 is a schematic illustration of a number of different symmetric cross-sectional alternatives for the configuration of blades utilizable with the apparatus according to the present invention.

FIG. 12 illustrates a number of possible cross-sectional shapes of a blade, the axis of symmetry of which is substantially parallel to the direction of movement 68 of the blade or to the tangent thereof. The leftmost cross-section illustrates either a quadrate cross-section of a blade 69. The second cross-section on the left, 70, illustrates a combination of a generally curved surface and planar surface, which may also be extended to a combination of two curved surfaces. This is, however, preferably a combination of a cylindrical surface and a planar surface. The cross-section in the middle, 71, illustrates a blade having, a shape of an isosceles triangle. The second from the right blade, 72, has the sides of a triangle "blown outwards", whereby the cross-section of the blade has a bullet-like appearance. It is also possible to manufacture the sides S inwardly bent, in other words concave, but this would increase the size of a gas bubble to some extent compared with the illustrated embodiment. The rightmost blade 73 is elliptic, although this description applies a round cross-section which is a special form of an ellipse.

At this stage it should be remembered that FIG. 11 illustrates cross-sectional shapes of the arm of the blade that are used for minimizing the size of the gas bubble, the corresponding cross-sectional forms are not used for the blade, because the blade would not be able to generate turbulence sufficient for mixing. Thus with a solid blade a compromise must always be found between the size of the gas bubble and the mixing efficiency. A rule of thumb is that both the size of the gas bubble and the mixing efficiency will increase in the same proportion, in other words, both factors are directly proportional to each other. In FIG. 12 the solid arrow 68 illustrates the direction of movement of a blade 69–73 according to the present knowledge, and the broken line arrow 74 illustrates a possible direction of movement of the blade 69–73, when taking all different applications and the compromising factors into consideration.

Figure 13:
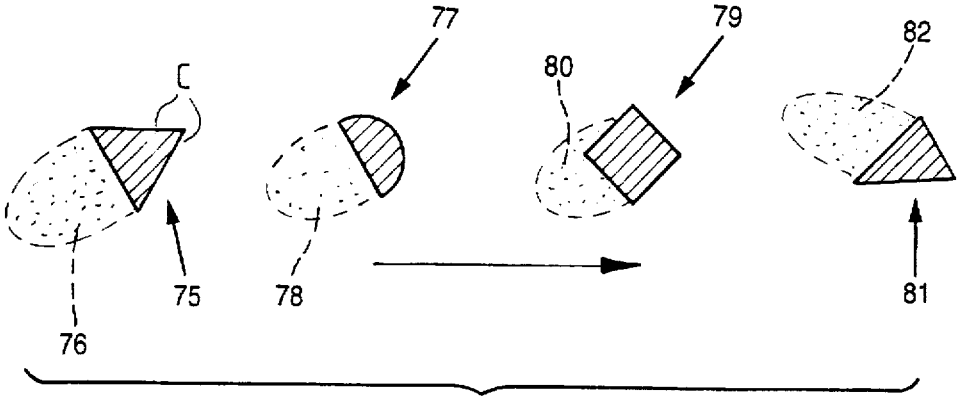
FIG. 13 schematically illustrates preferred asymmetrical cross-sectional configurations of an exemplary blade utilizable in the apparatus according to the present invention.

FIG. 13 illustrates a number of cross-sectional alternatives for a blade which are not symmetric, nor are their axes of symmetry parallel to the direction of movement of the blade nor to the tangent thereof. The leftmost configuration 75 is a blade of triangular crosssection or altered by providing it with slightly curved side surfaces C, directing the gas bubble 76 behind it below the longitudinal axis of the blade 75. The second to the left blade 77 has a semi-circular cross-section, presenting a combination of a plane and a curved surface or of two curved surfaces, leaving a considerably small gas trace 78 behind it. The blade 79 has a rectangular or square crosssection, which leaves a gas bubble 80 which does not significantly differ from the gas bubble of a corresponding object arranged symmetrically. The rightmost blade 81 has a triangular cross-section and is positioned at such an angle that the gas trace 82 accumulated behind the blade 81 flows as seen in FIG. 13. If it is, for example, imaged that the center of the rotor is located in FIG. 13 beneath the blade 75, 77,79, 81, the gas trace surface extends behind the tip of the rotating blade having the rightmost cross-section of FIG. 13. When taking into consideration the counter ribs operating together with the rotor blades illustrated in all of FIGS. 1–7, a counter rib, e.g. 36, 52 strikes most of the gas bubble 76, 78, 80, 82 and by breaking the bubble mixes the gas efficiently with the pulp. Blades such as 75, 77,79,81 are preferably used in the premixing zone (e.g. 28). If corresponding blades were used in the reaction zone (e.g. 48), there would be a risk that the gas bubble rotating behind the blade would become loose just at the discharge opening for pulp and be discharged with pulp. It is preferably to use a blade 75 in the reaction chamber (e.g. 48), so that the blade 75 itself keeps the gas bubble as far as the discharge opening for pulp as possible.

Figure 14A:
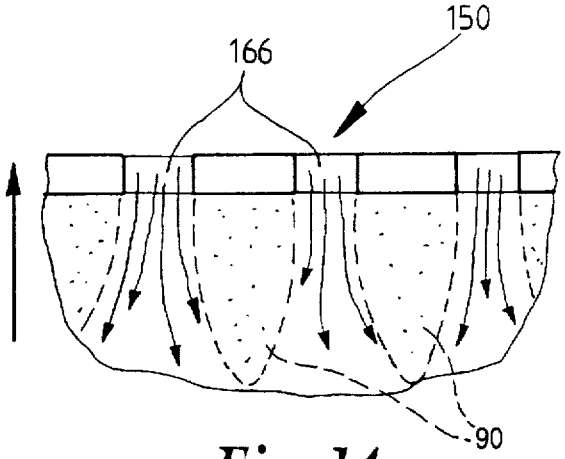
Figure 14B:
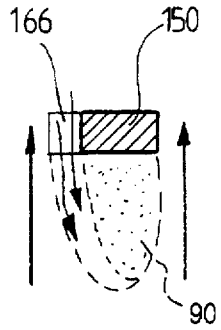

FIG. 14 schematically illustrates the effect of the cuttings at the edge of the blade, openings or like in the blade on the gas bubble behind the blade. FIGS. 14*a* and 14*b* illustrate a part of the blade 150 illustrated in FIG. 5, having an edge on the mixer casing side cutting 167 machined therein. Behind the blade 150 there is formed a gas trace 90 the size of which depends on the cross-sectional form of the blade 150, which is practically speaking equal in breadth and equally thick throughout the whole length of the blade 150. However, the cuttings 166 machined at the edge of the blade 150 allow the pulp to be discharged therethrough, so that the pulp being discharged through the cutting 166 behind the blade 150 tends to deflect the gas bubble 90. This results in a backwards spreading pulp jet. The final result is that the size of the gas bubble 90 has been reduced considerably more than what can be expected from the ratio of the size of the cuttings 166 to the unbroken surface of the blade 150. The size of the gas bubble 90 is reduced in both the circumferential direction (FIG. 14*a*) and in the radial direction (FIG. 14b), and the pulp jet widens in a similar manner.

Figure 14C:
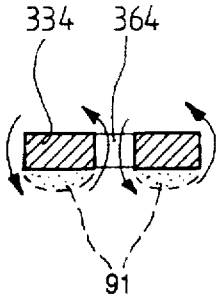

FIG. 14c illustrates yet another alternative arrangement, in which the edges of the blade 334 (shown in FIG. 6) have not been notched or cut (although they could quite as well be serrated, but the blade is for simplicity and clarity shown unnotched), and an opening 364 has been made to the middle part of the blade 334, through which opening 364 the pulp is discharged behind the blade 334. The pulp jet creates, in a way similar to that in FIG. 14*a*, a restriction or confinement of the gas bubble, limiting the bubble 91 to a size smaller than would be expected. However, when building a blade in this way, it must be taken into consideration that a strong pulp jet being discharged through the blade may prevent the flow desired around the blade 334. It may be wiser to limit the opening 364 in such a way that the flow begins to circulate through opening 364 according to the arrows shown in FIG. 14*c*, while maintaining the impact upon the desired gross flow of pulp around blade 334.

It is known in the art that power consumption is an indication of mixing efficiency. In other words, the better the mixer creates turbulence in the pulp, the higher is the power consumption. However, the benefits from mixing efficiency far outweigh the increased power consumption.

EXAMPLE

In performed experiments, a modified version of a known chemical mixer for mixing large amounts of gas was compared with a mixer in accordance with the present invention. It was discovered that the easiest way to compare these mixers was to monitor the change in energy required for mixing as a function of the gas amount in the gas-fiber suspension. In the experiments performed, and in theoretical calculations, it has been observed that in optimal mixing the mixing efficiency should reduce in the same ratio as the gas is added to the suspension., In other words, a 20% by volume gas addition should reduce the mixing efficiency only by about 20%.

Line 93 in FIG. 15 graphically illustrates the decease in the power consumption of a modified prior art chemical mixer as a function of the gas content and the rotational velocity of the rotor. In FIG. 15, the efficiency required for mixing pulp having 20% gas by volume has been compared with the efficiency required for mixing mere gas -free pulp. In other words, the 100% line 94 shows the efficiency required form mixing mere pulp and the lower curves the efficiency required form mixing pulp containing 20% gas by volume compared with the efficiency required for mixing ga-free pulp. It may be seen that, for example, the power consumption of the mixer in accordance with the prior art within the rational velocity range used in the experiments varied with gaseous pulp between about 40% and 23% from the efficiency required for mixing gaseous pulp. The power consumption in a mixer in accordance with the present invention—illustrated by line 95 in FIG. 15—reduced only 18–22%, whereas the reduction of power consumption of a mixer in accordance with prior art (line 93) was 60–77%.

It may be stated that the mixture of fiber suspension and gas is mixed by efficiency ptod, where:

$P_{tod}$=0.9 . . . 1.0* $(1-P_g/100)*P_{teor}$, and where preferably $P_{tod}$=0.95 . . . 1.0* $(1-P_g/100)*P_{teor}$, in which $P_g$=amount of gas in suspension as vol- % ; and $P_{teor}$=efficiency required for mixing of gas-free pulp.

One explanation for the great reduction in the power consumption of the mixer of the prior art is that a large number of the mixing elements of the mixer rotate in a "gas bubble", whereby the power requirement diminishes so that it is almost non-existent. In other words, a mixer in accordance with the prior art has hardly been able to mix gas at all, but the gas has been able to separate around the mixer members. Respectively, the small decrease in power consumption of the mixer in accordance with the present invention means that the power demand decreases only to the extent which the increase of gas diminishes the consistency of the pulp, which leads to the fact that the gas is equally distributed to the fiber suspension, on a microfloc or individual fiber level.

FIGS. 16*a* and 16*b* illustrate two more special applications of a mixer in accordance with the present invention. FIG. 16*a* illustrates a part of an ozone bleaching process in which the pulp raised to a relatively low pressure (about 4–8 bar) by a pump P1 is led to a mixer SD1, to which ozone gas together with the carrier gas is led either separately to together with pulp at a pressure higher than the pulp pressure (e.g. about 5–10 bar). The pulp is discharged from mixer S1 along a channel to a pump P2 located in close proximity to the mixer S1, the pump P2 raising the pressure, for example, to about 10 to 20 bar, so that the gas volume in the pulp decreases and according to the experiments the bleaching result is improved. By the pump P2 the pulp may be led either to a reactor specially designed for the purpose or, for example, along a conventional pipe line to the next treatment stage.

FIG. 16*b* illustrates a process in accordance with a second embodiment of the invention. It is a characterizing feature of the process of FIG. 16*b* that the pressurization of the pulp by the pump P1 to a low pressure and the mixing of ozone by the mixer S1 to the pulp takes place in the same way as in FIG. 16*a*, but the mixer S1 is not followed by a pump as a pressure-increasing apparatus as in FIG. 16*a*, but another a second mixer SP1, by which the pressure of the pulp may be raised about 10–20 bar. The advantage in the use of the second mixer SP1 is that if the gas is not completely equally distributed in the first mixer S1 with the pulp, this may be ensured by a pressure-increasing second mixer SP1 located immediately after the first mixer S1.

Of course a third alternative is to use a pressure-increasing mixer in the first mixing stage, whereby the process cannot be considered to be as efficient as the process in accordance with FIG. 16*b*, but however, sufficient for most purposes.

Yet another construction utilizing different mixing alternatives in accordance with the present invention is a pump pumping gascontaining material, as seen in FIGS. 17 and 18 (FIG. 18 taken along lines 18—18 of FIG. 17). The problem with all known centrifugal pumps is that when the material to be pumped is gas-containing the gas tends to separate in front of the impeller, because the impeller makes the material flow in the suction channel to turn into spiral flow, whereby the generating centrifugal force facilitates the separation of gas to the center of the flow. Previously this problem has been addressed by drawing the gas from the pump either through the openings arranged through the impeller or through a suction channel in a pipe led in front of the impeller.

The different rotor/blade/counter rib arrangements for mixing gas and/or preventing the separation of gas of the invention may be applied to the suction side of a centrifugal pump to prevent the separation of gas. They may be arranged at the suction side of a centrifugal pump in a similar way as the fluidizing rotor mounted to the shaft of a pump in front of an impeller as in MC® pumps sold by Kamyr, Inc. of Glens Falls, N.Y. Therefore the pump does not have to be provided with special gas discharge apparatus, but significantly less expensive apparatus preventing the separation of gas are sufficient. Thus all the features describe both in the previous description and set forth in the apparatus claims, may also be applied to a centrifugal pump, the suction channel of which corresponds to a mixer casing in the mixer construction illustrated above.

An exemplary centrifugal pump according to the invention is illustrated generally at 711 in FIGS. 17 and 18. Suspension enters inlet 716 and gas (e.g. ozone) inlet 720. The configuration of the rotor 722 is similar to the mixer of FIG. 1, as are the blade 734 configurations. In the "maintenance" chamber 748, however, pump impeller blades 98 are connected to the rotor 722, and the outlet 718 is tangential or spiral (i.e. corresponding to the volute of a conventional centrifugal pump, as seen in FIG. 18). The zone 740 is an intense mixing zone in a suction channel leading to impeller blades 98, and elements 746, 742 throttle the flow and homogenize the mixture.

In performed experiments even an apparatus designed to operate as a mixer is noted to increase pressure for at least five $mH_2O$, which suggests the gas treatment ability of the apparatus is fully under control, since the accumulation of the gas does not disturb the operation of the apparatus. In the mixer use the pressure-increasing feature is very advantageous, since, for example, in the dimensioning of an ozone bleaching plant the pressure loss in the mixer does not have to be taken into consideration, but it may even be considered to take care of at least a part of the work required for the transfer of pulp to the next treatment stage.

As may be seen from the above, it has been possible to develop a chemical mixer operating considerably more efficiently than those previously known for mixing large volumes of gas into medium consistency pulp without the risk of the separation of gas either in the middle of the mixing process or when having he suspension is discharged from the mixer. Although each of the previously described drawings illustrate different constructions, all features of the various constructions may be freely combined.

The invention also contemplates an embodiment in which both the premixing zone (e.g. 28) and the maintenance (e.g. 48) zone illustrated in the drawings are removed. In other words the homogenization zone (e.g. 40) is considered to be able to take care of the entire mixing process. The negative aspect of the exclusive use thereof is the high amount of power required. For minimizing the power usage the zones preceding and following the homogenization zone have proven advantageous.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Apparatus for mixing large volumes of gas into a medium consistency fiber suspension, comprising:

an elongated mixer casing having first and second ends and a circumferential substantially cylindrical wall extending continuously between said ends, at least one suspension inlet conduit in said wall and at least one suspension outlet conduit;

an elongated rotor mounted for rotation in said casing, and a shaft connected to said rotor;

means for driving said rotor shaft;

means for introducing gas into said casing adjacent said wall to mix with the medium consistency fiber suspension to form a mixture of gas and fiber suspension; and an intense mixing zone in said casing comprising means for both throttling the flow of suspension through the casing from the inlet to the outlet and homogenizing the mixture of gas and fiber suspension in the casing.

2. Apparatus as recited in claim 1 wherein said means for both throttling the flow of suspension and homogenizing the mixture comprises at least one throttling ring mounted on said mixer casing, and a plurality of mixing members cooperating with said at least one throttling ring, said throttling ring having a central opening through which the medium consistency fiber suspension passes during throttling.

3. Apparatus as recited in claim 2 wherein said throttling ring has a plurality of cogs radially extending into said opening in said ring.

4. Apparatus as recited in claim 2 wherein said at least one throttling ring comprises two throttling rings axially spaced along said casing; and wherein said rotor includes mixing surface manifestations disposed on an exterior surface thereof and disposed between said throttling rings.

5. Apparatus as recited in claim 1 wherein said casing is axially divided into at least two zones comprising a premixing zone, homogenization zone, and maintenance zone.

6. Apparatus as recited in claim 5 wherein said premixing zone is provided with means for fluidizing the fiber suspension to floc level and for distributing gas evenly throughout the entire premixing zone.

7. Apparatus as recited in claim 5 wherein a homogenization zone is provided, and wherein said homogenization zone includes means for fluidizing the gas-fiber suspension mixture generated in a pre-mixing zone to fiber or microfloc level and for passing the gas into contact with each fiber or microfloc.

8. Apparatus as recited in claim 5 wherein one of said zones is a maintenance zone, and wherein said maintenance zone is provided with means for maintaining the turbulence level of the homogeneous gas-fiber suspension mixture generated in a homogenization zone at a level high enough to prevent the generation of gas bubbles and to maintain the mixture homogeneous.

9. Apparatus as recited in claim 5 wherein said rotor has at least a portion which extends from said first end of said casing throughout said casing to close proximity to the second end thereof.

10. Apparatus as recited in claim 1 wherein said casing is divided into premixing, homogenization and maintenance zones.

11. Apparatus as recited in claim 1 wherein said intense mixing zone means for throttling and homogenizing includes mixing surface manifestations disposed on an exterior surface of said rotor, and cooperating mixing surface manifestations formed on an inner surface of said casing.

12. Apparatus as recited in claim 11 wherein said mixing surface manifestations comprise pins and cogs.

13. Apparatus as recited in claim 12 wherein said means for both throttling the flow of suspension and homogenizing the mixture comprises at least one throttling ring mounted on said mixer casing, and a plurality of mixing members cooperating with said at least one throttling ring, said throttling ring having a central opening through which the medium consistency fiber suspension passes during throttling.

14. Apparatus as recited in claims 13 wherein said throttling ring has a plurality of cogs radially extending into said opening in said ring.

15. Apparatus as recited in claim 14 wherein said at least one throttling ring comprises two axially-spaced throttling rings, and wherein at least some of said rotor mixing surface manifestations are disposed between said throttling rings.

16. Apparatus as recited in claim 11 wherein said means for both throttling the flow of suspension and homogenizing the mixture comprises at least one throttling ring mounted on said mixer casing, and a plurality of mixing members cooperating with said at least one throttling ring, said throttling ring having a central opening through which the medium consistency fiber suspension passes during throttling.

17. Apparatus as recited in claim 16 wherein said throttling ring has a plurality of cogs radially extending into said opening in said ring.

18. Apparatus as recited in claim 16 wherein said at least one throttling ring comprises two axially-spaced throttling rings; and wherein at least some of said rotor mixing surface manifestations are disposed between said throttling rings.

19. Apparatus as recited in claim 1 further comprising means for maintaining the fiber suspension in a fluidized state from said gas introducing means up to said suspension outlet.

20. Apparatus as recited in claim 19 wherein said means for maintaining the fiber suspension in a fluidized state from said gas introducing means up to said suspension outlet includes at least one rotor blade between said intense mixing zone and said suspension outlet.

21. Apparatus as recited in claim 1 further comprising protrusions extending from an interior surface of said casing and blades on said rotor, said blades having recesses formed therein cooperating with said protrusions to facilitate mixing of gas and suspension.

22. Apparatus as recited in claim 1 wherein said rotor has blades thereon, and further comprising openings in said blades for guiding fiber suspension to flow through said blades to mix gas tending to accumulate behind said blade back into the suspension.

23. Apparatus as recited in claim 1 wherein said outlet conduit has a cross-sectional area which tapers outwardly from said casing.

24. Apparatus as recited in claim 23 wherein said rotor has a tip portion which narrows adjacent said outlet conduit.

25. Apparatus for mixing large volumes of gas into a medium consistency fiber suspension, comprising:

a mixer casing having first and second ends, at least one suspension inlet conduit and at least one suspension outlet conduit;

a rotor mounted for rotation in said casing, and a shaft connected to said rotor;

means for driving said rotor shaft;

means for introducing gas into the casing so that the gas is at least 10% by volume of the medium consistency fiber suspension to mix with the fiber suspension to form a mixture of gas and fiber suspension;

an intense mixing zone in said casing comprising at least one throttling element for throttling the flow of fiber suspension through said casing; and means for maintaining the fiber suspension in a fluidized state from said gas introducing means up to said suspension outlet, including maintaining said fluidized state between said intense mixing zone and said suspension outlet.

26. Apparatus as recited in claim 25 wherein said at least one throttling element comprises at least one throttling ring mounted on said mixer casing, said throttling ring having a central opening through which the medium consistency fiber suspension passes during throttling.

27. Apparatus as recited in claim 26 wherein said throttling ring has a plurality of cogs radially extending into said opening in said ring.

28. Apparatus as recited in claim 26 wherein said at least one throttling ring comprises two throttling rings axially spaced along said casing; and wherein said rotor includes mixing surface manifestations disposed on an exterior surface thereof and disposed between said throttling rings.

29. Apparatus for mixing large volumes of gas into a medium consistency fiber suspension, comprising:

an elongated mixer casing having first and second ends and a circumferential wall, at least one suspension inlet conduit and at least one suspension outlet conduit;

an elongated rotor mounted for rotation in said casing about an axis of rotation extending through a radial center of said rotor, and a shaft connected to said rotor at said radial center;

means for driving said rotor shaft;

means for introducing gas into said casing radially offset from radial center to mix with the medium consistency fiber suspension to form a mixture of gas and fiber suspension;

an intense mixing zone in said casing comprising means for both throttling the flow of suspension through the casing from the inlet to the outlet and homogenizing the mixture of gas and fiber suspension in the casing; and means for maintaining the fiber suspension in a fluidized state from said gas introducing means to said suspension outlet.

30. Apparatus as recited in claim 29 wherein said rotor has at least a portion which extends from said first end of said casing throughout said casing to close proximity to the second end thereof.

31. Apparaus for mixing large volumes of gas into a medium consistency fiber suspension, comprising:

an elongated mixer casing having first and second ends and a circumferential wall, at least one suspension inlet conduit and at least one suspension outlet conduit;

an elongated rotor mounted for rotation in said casing, and a shaft connected to said rotor;

means for driving said rotor shaft;

means for introducing gas into said casing at a position where the fiber suspension is in a fluidized state due to the action of said rotor to mix with the medium consistency fiber suspenison to form a mixture of gas and fiber suspension;

an intense mixing zone in said casing comprising means for both throttling the flow of suspension through the casing from the inlet to the outlet and homogenizing the mixture of gas and fiber suspension in the casing; and means for maintaining the fiber suspension in a fluidized state from said gas introducing means up to said suspension outlet.

32. Apparatus as recited in claim 31 wherein said rotor has at least a portion which extends from said first end of said casing throughout said casing to close proximity to the second end thereof.

33. Apparatus for mixing large volumes of gas into a medium consistency fiber suspension, comprising:

an elongated mixer casing having first and second ends, at least one suspension inlet conduit and at least one suspension oulet conduit;

an elongated rotor mounted for rotation in said casing, and a shaft connected to said rotor;

means for driving said rotor shaft;

means for introducing gas into the casing to mix with the medium consistency fiber suspension to form a mixture of gas and fiber suspension;

an intense mixing zone in said casing comprising means for both throttling the flow of suspension through the casing from the inlet to the outlet and homogenizing the mixture of gas and fiber suspension in the casing; and means for maintaining the fiber suspension in a fluidized state from said gas introducing means up to said suspension outlet, including at least one rotor blade between said intense mixing zone and said suspension outlet.

34. Apparatus as recited in claim 33 wherein said rotor has at least a portion which extends from said first end of said casing throughout said casing to close proximity to the second end thereof.

35. Apparatus for mixing large volumes of gas into a medium consistency fiber suspension, comprising:

an elongated mixer casing having first and second ends, at least one suspension inlet conduit, and at least one suspesion outlet conduit;

an elongated rotor having a radially central surface mounted for rotation in said casing, and a shaft connected to said rotor;

means for driving said rotor shaft;

means for introducing gas into the casing to mix with the fiber suspension to form a mixture of gas and fiber suspension;

means for maintaining the fiber suspension in a fluidizied state from said gas introducing means up to said suspension outlet, said means including at least one blade attached to the rotor and radially spaced from said central rotor surface; and an intense mixing zone in said casing comprising means for both throttling the flow of suspension through the casing from the inlet to the outlet and homogenizing the mixture of gas and fiber suspension in the casing.

36. Apparatus as recited in claim 35 wherein said rotor has at least a portion which extends from said first end of said casing throughout said casing to close proximity to the second end thereof.

37. Apparatus for mixing large volumes of gas into a medium consistency fiber suspension, comprising:

an elongated substantially cylindrical mixer casing having first and second ends and a circumferential wall, at least one suspension inlet conduit, and a suspension outlet conduit, disposed in said circumferential wall of said casing and extending radially outwardly therefrom;

an elongated rotor mounted for rotation in said casing, and a shaft connected to said rotor;

means for driving said rotor shaft;

means for introducing gas into the casing to mix with the fiber suspension to form a mixture of gas and fiber suspension;

means for maintaining the fiber suspension in a fluidized state from said gas introducing means up to said oulet; and an intense mixing zone in said casing comprising means for both throttling the flow of suspension through the casing from the inlet to the outlet and homogenizing the mixture of gas and fiber suspension in the casing.

38. Apparatus as recited in claim 37 wherein said mixer casing is substantially cylindrical, and wherein said rotor has at least a portion which extends from said first end of said casing throughout said casing to close proximity to thesecond end thereof.

39. Apparatus as recited in claim 37 wherein said means for maintaining the fiber suspension in a fluidized state from said gas introducing means up to said suspension outlet includes at least one rotor blade between said intense mixing zone.

40. Apparatus as recited in claim 37 wherein said outlet conduit is substantially tangential to said casing circumferential wall.

* * * * *